US006679952B2

(12) United States Patent
Shimizu et al.

(10) Patent No.: US 6,679,952 B2
(45) Date of Patent: Jan. 20, 2004

(54) METHOD OF COATING ALUMINUM AND ALUMINUM ALLOY SUBSTRATES AND COATED ARTICLES

(75) Inventors: Toru Shimizu, Toyohashi (JP); Takayuki Sato, Toyokawa (JP); Tatsuya Oguri, Toyokawa (JP); Keiji Maetsuji, Sanda (JP); Kazuo Nobe, Kyoto (JP)

(73) Assignees: Topy Industries, Limited, Tokyo (JP); Nippon Paint Co., Ltd., Osaka (JP)

( * ) Notice: Subject to any disclaimer, the term of this patent is extended or adjusted under 35 U.S.C. 154(b) by 139 days.

(21) Appl. No.: 09/974,458

(22) Filed: Oct. 10, 2001

(65) Prior Publication Data

US 2003/0070730 A1 Apr. 17, 2003

(51) Int. Cl.[7] ..... C23C 22/48

(52) U.S. Cl. ..... 148/247; 148/253; 148/254; 148/256; 148/268; 148/275; 427/309; 427/344

(58) Field of Search ..... 148/243, 247, 148/253, 254, 256, 268, 275; 428/472.2, 472.3; 427/309, 344

(56) References Cited

U.S. PATENT DOCUMENTS 4,851,148 A * 7/1989 Yamasoe et al. ..... 134/3
5,053,081 A * 10/1991 Jacob ..... 106/287.11
5,290,625 A * 3/1994 Eisfeller et al. ..... 428/216

FOREIGN PATENT DOCUMENTS

JP 09020984 A * 1/1997 ..... C23C/22/36

* cited by examiner

*Primary Examiner*—John Sheehan
*Assistant Examiner*—Andrew L. Oltmans
(74) *Attorney, Agent, or Firm*—Jordan and Hamburg LLP

(57) ABSTRACT

A method of coating aluminum and aluminum alloy substrates not only imparts a corrosion resistance comparable or even superior to that afforded by chromate treatment but also improves the adhesion to the coating film, while the luster of aluminum is fully retained, notwithstanding the use of a chromium-free treating solution, resulting in an improved coated article with the coated surface having a metallic luster. The method comprises treating an aluminum or aluminum alloy substrate with an acidic solution containing sulfuric acid and 0.2 to 0.4 g/L of a ferric ion and having a pH value of 0.6 to 2.0, subjecting the same to chemical conversion treatment with an acidic coat-forming agent containing 0.01 to 0.125 g/L of a zirconium or titanium ion, 0.01 to 1.0 g/L of a phosphate ion, and 0.01 to 0.5 g/L of a fluoride ion and having a pH value of 1.5 to 4.0, followed by coating.

7 Claims, No Drawings

METHOD OF COATING ALUMINUM AND ALUMINUM ALLOY SUBSTRATES AND COATED ARTICLES

TECHNICAL FIELD

The present invention relates to a method for coating aluminum and aluminum alloy substrates and to a coated article.

BACKGROUND ART

Aluminum and aluminum alloy substrates have the intrinsic luster of the material and are lightweight, and by taking advantage of these properties, they are being used in increasing quantities in a variety of fields. For example, automotive wheels were mostly made of iron in the past but as higher-grade, lightweight cars came to be the order of the day, the demand has been expanding for aluminum wheels made of aluminum alloy substrates.

Generally, aluminum substrates are not sufficiently resistant to corrosion despite the above-mentioned properties so that even a surface mar may readily develop into filiform corrosion and an oxide film also tends to be formed on the surface. Furthermore, aluminum alloy substrates tend to suffer from the floating-up of those other components added for increased strength as surface impurity and if such substrates are directly coated, no sufficient adhesion to the coating film may be obtained. Therefore, these substrates are surface-treated for improved corrosion resistance, adhesion and other performance characteristics.

The technology for surface treatment of an aluminum wheel comprises after degreasing, subjecting it to anodic oxidation, for example by the Alumite process, coloring process, or a chemical coat treatment, for example by the chromate treatment, MBV process, boemite process or the like. Among these processes, the chromate treatment is used with particular advantage, since this treatment can further improve coating film adhesion and corrosion resistance.

However, the chromate treatment gives a khaki-colored chromate coat which overshadows the surface luster of the aluminum or aluminum alloy substrate, although it is capable of imparting good corrosion resistance. Therefore, in uses where the luster of the material is required as is the case with aluminum wheels, the amount of chromium deposition is restricted and consequently no sufficient corrosion resistance can be imparted in some cases.

Japanese Kokai Publication Hei-5-179486 discloses a method of forming a colorless chromate coat for lustrous aluminum wheels, which comprises subjecting the surface of an aluminum wheel to cathode electrolysis with an acidic chromate ion-containing solution to form a transparent chromate coat. Since the chromate coat is transparent in this method, light may penetrate the coat and reach the substrate surface so that the luster of the material is not compromised. However, in view of the recent alertness to the toxicity of chromium, treatment with a chromium-free treating solution is recommended.

At the present, the non-chromate treatment using a chromium-free treating solution is also practiced but the corrosion resistance is insufficient as compared with the chromate treatment, although it is acceptable from the stand point of environmental safety. In order to impart sufficient corrosion resistance, the film thickness must be increased but the luster of the material will be adversely affected in result.

Particularly in coating of aluminum wheels, where a deluxe finish is an important requirement, not only are good corrosion resistance and good adhesion required but the luster of the material must be exploited. However, these requirements cannot be satisfied by the treating technologies referred to above.

While aluminum and aluminum alloy substrates are used for aluminum cans for beverages and foods, the surface treatment technique for them comprises pickling, degreasing and chemical conversion treatment, optionally followed by after treatment.

Japanese Kokoku Publication Hei-3-50838 discloses a surface cleaning agent comprising a ferric ion and sulfuric and/or nitric acid. This is intended to be applied to aluminum cans for beverages to be fabricated by the drawing and ironing (DI) process for the removal of smuts composed of lubricating oil and aluminum powder deposited on the aluminum surface during processing.

Japanese Kokoku Publication Sho-56-33468 discloses a coating agent comprising a zirconium or titanium ion, a phosphate ion and a fluoride ion. This is used for improving the corrosion resistance and coating film adhesion of aluminum cans.

Japanese Kokai Publication Sho-59-219478 discloses a water-borne after-treating agent comprising a reactive functional group-containing organoalkoxysilane compound. This is used for improving the corrosion resistance and coating film adhesion of the aluminum substrate surface subjected to chemical conversion treatment with zinc phosphate.

These technologies provide chromium-free treating agents and are satisfactory in terms of environmental hygiene but the applicable aluminum or aluminum alloy substrate is not for use in applications requiring a luster, such as aluminum cans for beverages and foods and it is questionable whether these are technologies adequate for the pre-treatment for aluminum wheels which are required to retain the luster of the substrate.

In light of the above state of the art, the present invention has for its object to provide a method of coating aluminum and aluminum alloy substrates by which not only a corrosion resistance comparable or even superior to that afforded by chromate treatment can be imparted but also the adhesion to the coating film can be improved, while the luster of aluminum is fully retained, notwithstanding the use of a chromium-free treating solution, as well as a coated article with the surface coated by the above method and having a metallic luster.

SUMMARY OF THE INVENTION

The present invention is directed to a method of coating aluminum and aluminum alloy substrates which comprises treating an aluminum or aluminum alloy substrate with an acidic solution containing sulfuric acid and 0.2 to 0.4 g/L of a ferric ion and having a pH value of 0.6 to 2.0, subjecting the same to chemical conversion treatment with an acidic coat-forming agent containing 0.01 to 0.125 g/L of a zirconium or titanium ion, 0.01 to 1.0 g/L of a phosphate ion, and 0.01 to 0.5 g/L of a fluoride ion and having a pH value of 1.5 to 4.0, followed by coating.

The present invention is further directed to a method of coating aluminum and aluminum alloy substrates which comprises treating an aluminum or aluminum alloy substrate with an acidic solution containing sulfuric acid and 0.2 to 0.4 g/L of a ferric ion and having a pH value of 0.6 to 2.0, subjecting the same to chemical conversion treatment with an acidic coat-forming agent containing 0.01 to 0.125 g/L of a zirconium or titanium ion, 0.01 to 1.0 g/L of a phosphate ion, and 0.01 to 0.5 g/L of a fluoride ion and having a pH value of 1.5 to 4.0, treating the same with an aqueous solution containing 0.1 to 10 g/L of organoalkoxysilane and having a pH value of 10 to 12, followed by coating.

The present invention is further directed to a coated article which is coated by the above methods of coating aluminum and aluminum alloy substrates according to the invention.

In the following, the present invention is described in detail.

DETAILED DESCRIPTION OF THE INVENTION

The present invention is a method of coating aluminum and aluminum alloy substrates which comprises treating an aluminum or aluminum alloy substrate with an acidic solution, subjecting the same to chemical conversion treatment with an acidic coat-forming agent followed by coating.

Preferred as said aluminum or aluminum alloy substrate (e.g. AC4C or AC4CH) is an aluminum wheel. Since the coating method of the invention not only provides a coating film with good corrosion resistance and adhesion but also insures the surface luster retained, it can be applied with advantage to aluminum wheels which are required to have a lustrous appearance.

In the practice of the invention, the above aluminum or aluminum alloy substrate is degreased where necessary. The above method for degreasing is not particularly restricted but the method used for the routine treatment of aluminum substrates, such as alkali degreasing cleaning, can be employed.

The above method for degreasing is not particularly restricted, but for effective degreasing, such cleaning is preferably carried out as by the dipping technique.

The above aluminum or aluminum alloy substrate is first treated with an acidic solution containing 0.2 to 0.4 g/L of a ferric ion and sulfuric acid and having a pH value of 0.6 to 2.0. This is a pickling process, by which the surface soil and oxide film are removed from the surface of aluminum and aluminum alloy substrates.

In the above acidic solution, said ferric ion plays the role of promoting the etching of aluminum by sulfuric acid.

The above ferric ion content in the above acidic solution is 0.2 to 0.4 g/L. When it is less than 0.20 g/L, accelerating effect of the etching speed is so small that the result of etching tends to be insufficient. When it exceeds 0.4 g/L, the aluminum surface is overetched. Therefore, it is restricted within the above range.

The source of said ferric ion is not particularly restricted but includes, for example, water-soluble ferric salts such as $Fe_2(SO_4)_3$, $Fe(NO_3)_3$, $Fe(ClO_4)_3$, etc. and water-soluble ferrous salts such as $FeSO_4$ and $Fe(NO_3)_2$, and the like. Among these, $Fe_2(SO_4)_3$ and $FeSO_4$, which can provide sulfate ions, are preferably used.

When the above water-soluble ferrous salt is used as the source of said ferric ion, it is preferred to add an equivalent amount of an oxidizing agent to an acidic aqueous solution containing the above water-soluble ferrous salt to oxidize the required amount of the ferrous ion to the ferric ion.

The above sulfuric acid content in said acidic solution is preferably 10.6 to 12.4 g/L in terms of sulfate ion. If it is less than 10.6 g/L, the surface etching of aluminum will be insufficient. If it exceeds 12.4 g/L, the aluminum surface will be overetched.

The source of said sulfate ion is not particularly restricted but includes, for example, $H_2SO_4$, $Fe_2(SO_4)_3$ and $FeSO_4$, and the like.

The pH of the above acidic solution is 0.6 to 2.0. Below pH 0.6, the aluminum surface is overetched. If it exceeds pH 2.0, the etching speed of aluminum will be drastically decreased. Therefore, it is restricted within the above range.

Adjustment of the above pH is preferably made with $H_2SO_4$ which is a sulfate ion source mentioned above.

Where necessary, said acidic solution may be added with a fluoride ion, a surfactant and the like.

The above-mentioned pickling is generally carried out at a treating temperature of 30 to 75° C., preferably 35 to 45° C., for a treating time of about 1 to 5 minutes, preferably about 3 minutes.

The above pickling method is not particularly restricted but includes, for example, the dipping method, the spray method and the like.

By the above pickling, the oxide coat on the surface of aluminum and aluminum alloy substrates can be effectively removed and, at the same time, the components other than aluminum such as Mg, Si, Cu and the like impurities in aluminum alloy which have floated up on the surface can also be removed. For this reason, chemical conversion treatment, which will be described in detail hereinafter, can be carried out with greater success.

The aluminum or aluminum alloy substrate treated with the above pickling is generally washed with water so that the above acidic solution will not be carried over to the subsequent step. The method for the above-mentioned aqueous washing is not particularly restricted but includes the method in routine use by the surface treatment of metals.

In the coating method of the invention, the aluminum or aluminum alloy substrate is subjected to chemical conversion treatment, after the above pickling step, with an acidic coat-forming agent comprising 0.01 to 0.125 g/L of a zirconium or titanium ion, 0.01 to 1.0 g/L of a phosphate ion and 0.01 to 0.5 g/L of a fluoride ion and having a pH value of 1.5 to 4.0.

The zirconium or titanium ion mentioned above is a coat-forming component of said acidic coat-forming agent.

The above zirconium or titanium ion content in the above acidic coat-forming agent is 0.01 to 0.125 g/L. If it is less than 0.01 g/L, the formed coat weight will be insufficient and, hence, the corrosion resistance and other performance characteristics will be insufficient. If it exceeds 0.125 g/L, the formed coat weight will be too great that the resulting coat will have an excessive thickness hence the luster of the aluminum or aluminum alloy substrate will be impaired. Therefore, it is restricted within the above range.

The source of said zirconium ion is not particularly restricted but includes, for example, soluble fluorozirconates such as fluorozirconate, fluorozirconic acid, etc.; $(NH_4)_2ZrF_6$; alkali metal fluorozirconates; zirconium fluoride and so forth.

The source of said titanium ion is not particularly restricted but includes, for example, soluble fluorotitanates such as fluorotitanate, fluorotitanic acid, etc.; $(NH_4)_2TiF_6$; alkali metal fluorotitanates; titanium fluoride and so forth.

In the above acidic coat-forming agent, said phosphate ion is one of the coat-forming components and contributes to the corrosion resistance and tackiness of the resulting coat.

The above phosphate ion content in the above acidic coat-forming agent is 0.01 to 1.0 g/L. If it is less than 0.01 g/L, the weight of the resulting coat will be insufficient and the corrosion resistance and other performance characteristics will be insufficient. If it exceeds 1.0 g/L, the coat will have an excessive thickness. Therefore, it is restricted within the above range.

The source of said phosphate ion is not particularly restricted but includes, for example, phosphoric acid and phosphoric acid compounds soluble in acidic solution, such as ammonium phosphate, alkali metal phosphate salts and the like. The preferred above-mentioned phosphate ion source is orthophosphoric acid, although metaphosphoric acid, pyrophosphoric acid, tripolyphosphoric acid, hypophosphoric acid, and salts thereof may also be employed.

In the acidic coat-forming agent, said fluoride ion plays the role of an etching agent for aluminum.

The above fluoride ion content in the above acidic coat-forming agent is 0.01 to 0.5 g/L. If it is less than 0.01 g/L, the etching on the aluminum or aluminum alloy substrate surface will be insufficient and the resulting coat weight will also be inadequate. If it exceeds 0.5 g/L, the surface of the aluminum or aluminum alloy substrate will be overetched so that the surface of said substrate will assume a dull appearance as if frosted. Therefore, it is restricted within the above range.

The source of said fluoride ion is not particularly restricted insofar as it is soluble in the above acidic coat-forming agent and capable of forming a complex with aluminum as well as does not interfere with the above chemical conversion treatment. Thus, for example, hydrofluoric acid, hydrofluoride salts, fluoroboric acid, etc. can be mentioned. When a complex of zirconium or titanium, such as the complexes mentioned above, is used as the above fluoride ion source, the amount of fluoride ion produced is insufficient and, therefore, said fluorine component is preferably used in combination.

The pH of said acidic coat-forming agent is 1.5 to 4.0. Below pH 1.5, the surface of the aluminum or aluminum alloy substrate will be overetched. If it exceeds 4.0, the etching of the aluminum or aluminum alloy substrate surface will be insufficient. Therefore, it is restricted within the above range. The preferred range is pH 2.6 to 3.1.

Adjustment of the pH of said acidic coat-forming agent is preferably carried out using an acid or base which does not adversely affect the above chemical conversion treatment, such as nitric acid, ammonium hydroxide, perchloric acid, sulfuric acid, or the like. When sulfuric acid is used, the pH of said acidic coat-forming agent is preferably not less than 2.

The preferred weight of the coat to be formed by the above chemical conversion treatment is 5 to 50 mg/m$^2$. If it is less than 5 mg/m$^2$, corrosion resistance and other performance characteristics will be inadequate. If it exceeds 50 mg/m$^2$, the excessive film thickness tends to detract from the luster of aluminum and, in addition, the corrosion resistance tends to be rather sacrificed in some cases.

The above chemical conversion treatment can be carried out in such a manner that the resulting coat weight will fall within the above-mentioned range. Generally, this treatment is preferably carried out at a treating temperature of 35 to 45° C. for a treating time of 40 to 50 seconds. The more preferred conditions are at 40° C. and for about 45 seconds.

The procedure for the above chemical conversion treatment is not particularly restricted but includes, for example, the dipping method, the spray method and the like.

In the present invention, the above aluminum or aluminum alloy substrate is washed with water, dried, and coated after said chemical conversion treatment.

The above coating is preferably carried out using a powder coating to improve the adhesion to the coating film. Since, in the present invention, pickling is carried out as pre-treatment of coating, a good coating film adhesion can be expected even with powder coating.

The coating to be used in the above coating is not particularly restricted but in order to retain the surface luster of aluminum and aluminum alloy substrates, an acrylic clear coating is preferably employed.

The second aspect of the present invention is directed to a method of coating aluminum and aluminum alloy substrates which comprises treating an aluminum or aluminum alloy substrate with an acidic solution containing sulfuric acid and 0.2 to 0.4 g/L of a ferric ion and having a pH value of 0.6 to 2.0, subjecting the same to chemical conversion treatment with an acidic coat-forming agent containing 0.01 to 0.125 g/L of a zirconium or titanium ion, 0.01 to 1.0 g/L of a phosphate ion, and 0.01 to 0.5 g/L of a fluoride ion and having a pH value of 1.5 to 4.0, treating the same with an aqueous solution containing 0.1 to 10 g/L of organoalkoxysilane and having a pH value of 10 to 12, followed by coating.

In the coating method according to the second aspect of the invention, the substrate is degreased where necessary and, then, subjected to pickling and chemical conversion treatment as same as the coating method of the first aspect of the invention. Then, after treatment is carried out using an aqueous solution containing 0.1 to 10 g/L of organoalkoxysilane and having a pH value of 10 to 12. By carrying out the above aftertreatment, a thin film can be formed on the coat surface following chemical conversion to insure a still better adhesion to the coating film, thus contributing to a better coating result.

The above organoalkoxysilane compound in said aqueous solution functions to improve the adhesion to the coating film.

The above organoalkoxysilane content in said aqueous solution is 0.1 to 50 g/L. If it is less than 0.1 g/L, the coating film adhesion will be insufficient. If it exceeds 50 g/L, not only will the coating film adhesion be inadequate but the coating film will be deposited in segregation to give scales which are liable to shed off. Therefore, it is restricted within the above range.

The organoalkoxysilane compound mentioned above is preferably an organoalkoxysilane compound having at least one species of reactive functional group selected from the group consisting of carbon—carbon double bond, epoxy group, mercapto group and amino group. Thus, for example, γ-aminopropyltriethoxysilane, γ-methacryloxypropyltriethoxysilane, vinyltrimethoxysilane, vinyltriethoxysilane, γ-glycidoxypropyltrimethoxysilane, γ-glycidoxypropyltriethoxysilane, etc. can be mentioned.

The pH of said aqueous solution is 10 to 12. If the pH is below 10 or above 12, the bath solution stability will be poor so that no efficient aftertreatment can be carried out. Therefore, it is restricted within the above range.

The above aftertreatment is carried out preferably at a treating temperature of 15 to 40° C. for a treating time of 30 to 60 seconds.

In the second aspect of the present invention, said aluminum or aluminum alloy substrate is washed with water, dried and coated after the above-mentioned aftertreatment.

Since aftertreatment has been carried out to enhance the coating film adhesion, the above coating may give a coating film with good adhesion whichever solvent-based coating or powder coating is employed. From the standpoint of environmental safety, the use of powder coating is preferred in the practice of the invention.

In the method of coating aluminum and aluminum alloy substrates according to the invention, the sequence of pickling-chemical conversion treatment or the sequence of pickling-chemical conversion treatment-aftertreatment is carried out prior to coating. Each of these steps contributes much to obtain a coated article retaining the luster of aluminum as well as having excellent corrosion resistance and coating film adhesion.

Thus, pickling is a step for removing impurity from the substrate surface and chemical conversion treatment is a step for forming a coat with good corrosion resistance, good coating film adhesion and high transparency. Aftertreatment is a step for forming a thin film to further improve coating film adhesion.

Therefore, by passing through the above series of steps, surface cleaning of the aluminum or aluminum alloy substrate and provision of the substrate with corrosion resistance and the like performance characteristics are serially effected to ultimately give a coated article retaining the luster of aluminum and having excellent corrosion resistance and other performance characteristics. The coated article obtained in this manner also constitutes an aspect of the present invention.

Furthermore, while a treating solution not containing the toxic chromium is used for chemical conversion treatment in the method of coating aluminum and aluminum alloy substrates according to the invention, the method is not like the conventional non-chromate method in that it gives a coat having performance characteristics comparable or even superior to the coat obtained by the chromate treatment. Since the burden of treating the waste water inclusive of the effluent from chemical conversion treatment is thus reduced, the method of the invention is a coating method favorable from the standpoint of environmental hygiene.

The method of coating aluminum and aluminum alloy substrates according to the present invention, described hereinabove, is capable of forming a coating film which is not only good in corrosion resistance, coating film adhesion and other performance characteristics but also insures the luster of aluminum retained without using a treating solution containing the toxic chromium.

Since the coated article of the invention coated by the method of coating aluminum and aluminum alloy substrates of the invention, it is excellent in corrosion resistance and coating film adhesion as well as retains the luster of aluminum, thus can be preferably applied in those uses calling for a high-grade finish.

BEST MODE FOR CARRYING OUT THE INVENTION

The following examples describe the present invention in further detail, however, they are by no means limitative of the scope of the invention.

EXAMPLES 1 TO 5, COMPARATIVE EXAMPLES 1 TO 4

Aluminum wheels were molded from aluminum alloy (AC4C) and each molding was taken out of the mold and surface-treated by shot blasting and machining. The substrate thus treated was subjected to a series of degreasing, aqueous washing, pickling, aqueous washing, chemical conversion treatment, aqueous washing, and aftertreatment under the conditions specified below, followed by drying and coating. The aqueous washing was carried out in a shower system using tap water and treatments for all the above steps were carried out by the dipping method. Drying was performed using an electric dryer at 120° C. for at least 10 minutes. The formulation of each treating solution is shown in Table 1.

(A) Degreasing

Treating solution: Surf Cleaner 53 (non-etching type) (product of Nippon Paint Co.), 2% (w/v)

Treating temperature: 50° C.

Treating time: 3 min.

(B) Pickling Treatment

Treating temperature: 40° C.

Treating time: 3 min.

(C) Chemical Conversion Treatment

Control treating solution: Alsurf 1000 (product of Nippon Paint Co.) (a commercial chromium-chromate treating agent)

Treating temperature: 40° C.

Treating time: As indicated in Table 1.

(D) Aftertreatment

Treating temperature: room temperature

Treating time: 30 sec.

(E) Coating

Powder system: Undercoating with Powdax A400 (an acrylic powder coating; product of Nippon Paint Co.) and top coating with Superlac AS70 11SV-14 (an acrylic solvent-borne paint; product of Nippon Paint Co.) and Superlac 5000 AW-10 (an acrylic solvent-borne paint; Nippon Paint Co.)

Solvent system: Coating with Superlac AS70 11SV-14 (an acrylic solvent-borne coating; product of Nippon Paint Co.) and Superlac 5000 AW-10 (an acrylic solvent-borne coating; product of Nippon Paint Co.)

For each coated article obtained, the coat weight was determined and the water resistance test, salt spray test, cycle corrosion test and filiform corrosion resistance test were carried out on the machined surface or the shot surface. The results are shown in Table 1.

Determination of Coat Weight

It is analyzed by fluorescent X-ray as the quantitation of deposited zirconium or chromium.

Water Resistance Test

Cuts were made at 2 mm pitches in the coating film and after 72 hours of immersion in water at 60° C., a Nichiban® tape was applied to the cut area. After the tape was peeled off, the number of squares adherent to the tape were counted.

○: 0/100

X: ≧1/100

Salt Spray Test

A crosscut was made in the coating film and after 1200 hours of salt solution spraying, the width of corrosion on one side of the crosscut was measured.

Cycle Corrosion Test

A crosscut was made in the coating film and after 60 cycles of salt solution spray 17 hr→forced drying 3 hr→salt solution dip2 hr→airdrying (room temperature) 2 hr [CCT (cycle corrosion test) cycle], the width of corrosion on one side of the crosscut was measured.

Filiform Corrosion Resistance Test

A crosscut was made in the coating film and after 12 cycles of salt solution spray 24 hr→humidification (85% RH, 40° C.) 120 hr→airdrying (room temperature) 24 hr, the width of corrosion on one side of the crosscut was measured.

TABLE 1

| | | Examples | | | | | Comparative Examples | | | |
|---|---|---|---|---|---|---|---|---|---|---|
| | | 1 | 2 | 3 | 4 | 5 | 1 | 2 | 3 | 4 |
| Pickling | $FeSO_4 \cdot 7H_2O$ (g/L) | 0.81 | 0.81 | 0.81 | 0.81 | 0.81 | — | — | 0.81 | — |
| | 98% $H_2SO_4$ (g/L) | 12.1 | 12.1 | 12.1 | 12.1 | 12.1 | — | — | 12.1 | — |
| | pH | 0.9 | 0.9 | 0.9 | 0.9 | 0.9 | — | — | 0.9 | — |
| Chemical conversion | $(NH_4)_2ZrF_6$ (g/L) | 0.12 | 0.12 | 0.12 | 0.12 | 0.12 | 0.12 | — | — | 0.12 |
| | 75% $H_3PO_4$ (g/L) | 0.10 | 0.10 | 0.10 | 0.10 | 0.10 | 0.10 | — | — | 0.10 |
| | 55% HF (g/L) | 0.02 | 0.02 | 0.02 | 0.02 | 0.02 | 0.02 | — | — | 0.02 |
| | 42% $HBF_4$ (g/L) | 0.16 | 0.16 | 0.16 | 0.16 | 0.16 | 0.16 | — | — | 0.16 |
| | $K_2ZrF_6$ (g/L) | — | — | — | — | — | — | 0.39 | 0.39 | — |
| | $CrO_3$ (g/L) | — | — | — | — | — | — | 0.62 | 0.62 | — |
| | pH | 3.5 | 3.5 | 3.5 | 3.5 | 3.5 | 3.5 | 2.6 | 2.6 | 3.5 |
| | Treating time | 45 sec. | 45 sec. | 45 sec. | 45 sec. | 90 sec. | 45 sec. | 2 min. | 2 min. | 90 sec. |
| Aftertreatment | Organoalkoxysilane compound (g/L) | — | 0.5 | 1.0 | — | — | 1.0 | 0.5 | — | — |
| | pH | — | 10.4 | 10.5 | — | — | 10.5 | 10.4 | — | 10.4 |
| Coating system | | Solvent | Powder | Powder | Powder | Solvent | Powder | Powder | Powder | Powder |
| Coat weight ($mg/m^2$) (machined surface) | | 30 | 30 | 30 | 30 | 60 | 15 | 8 (Cr) | 13 (Cr) | 30 |
| Water resistance (machined surface/shot surface) | | ○ | ○ | ○ | ○ | ○ | ○ | ○ | ○ | ○ |
| SST, one side (mm) (machined surface/shot surface) | | 0.7/1.0 | 0/0 | 0.2/0 | 0/1.0 | 0.5/0.8 | 0.2/0.5 | 1.0/3.0 | 0/0 | 0/1.0 |
| CCT, one side (mm) (machined surface/shot surface) | | 1.0/1.0 | 0/1.0 | 0/1.0 | 0/0 | 1.0/1.0 | 0/1.0 | 0/0 | 0/0 | 0/1.5 |
| Filiform corrosion resistance test, one side (mm) (machined surface/shot surface) | | 0/3 | 0/2.5 | 0/0 | 0/0 | 0/5.5 | 0/4.5 | 0/1.0 | 0/1.0 | 0/4.0 |

In the Table, the organoalkoxysilane compound is $(C_2H_5O)_3SiC_3H_6NH_2$ (γ-aminopropyltriethoxysilane).

It was found from the above results that the substrate subjected to pickling treatment and chemical conversion treatment was good in corrosion resistance and coating film adhesion, having equivalent or even superior performance characteristics to the substrate subjected to the conventional chromate treatment. It was also found that, in the case of nonchromating, pickling treatment was essential.

What is claimed is:

1. A method of coating aluminum and aluminum alloy wheels which comprises treating an aluminum or aluminum alloy wheel with an acidic solution containing sulfuric acid and 0.2 to 0.4 g/L of a ferric ion and having a pH value of 0.6 to 2.0, subjecting the same to chemical conversion treatment with an acidic coat-forming agent containing 0.01 to 0.125 g/L of a zirconium or titanium ion, 0.01 to 1.0 g/L of a phosphate ion, and 0.01 to 0.5 g/L of a fluoride ion and having a pH value of 1.5 to 4.0, followed by coating.

2. The method of coating aluminum and aluminum alloy wheels according to claim 1, wherein the weight of the coat formed by chemical conversion treatment is 5 to 50 $mg/m^2$.

3. The method of coating aluminum and aluminum alloy wheels according to claim 1, wherein the coating is powder coating.

4. A method of coating aluminum and aluminum alloy wheels which comprises treating an aluminum or aluminum alloy wheel with an acidic solution containing sulfuric acid and 0.2 to 0.4 g/L of a ferric ion and having a pH value of 0.6 to 2.0, subjecting the same to chemical conversion treatment with an acidic coat-forming agent containing 0.01 to 0.125 g/L of a zirconium or titanium ion, 0.01 to 1.0 g/L of a phosphate ion, and 0.01 to 0.5 g/L of a fluoride ion and having a pH value of 1.5 to 4.0, and treating the same with an aqueous solution containing 0.1 to 10 g/L of organoalkoxysilane and having a pH value of 10 to 12, followed by coating.

5. The method of coating aluminum and aluminum alloy wheels according to claim 4, wherein the weight of the coat formed by chemical conversion treatment is 5 to 50 $mg/m^2$.

6. The method of coating aluminum and aluminum alloy wheels according to claim 4, wherein coating is solvent-based coating.

7. The method of coating aluminum and aluminum alloy wheels according to claim 4, wherein coating is powder coating.

* * * * *